US012151874B1

(12) United States Patent
Block et al.

(10) Patent No.: US 12,151,874 B1
(45) **Date of Patent: *Nov. 26, 2024**

(54) ARTICLE CARRIER WITH INTEGRATED COOLER AND METHOD OF MANUFACTURING

(71) Applicant: Leftcoast Innovations LLC, Joliet, IL (US)

(72) Inventors: Joseph Block, New Port Richey, FL (US); Austin Rovetti, Venice, CA (US)

(73) Assignee: Leftcoast Innovations LLC, New Port Richey, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/376,293

(22) Filed: Oct. 3, 2023

Related U.S. Application Data

(63) Continuation of application No. 17/567,604, filed on Jan. 3, 2022, now Pat. No. 11,772,874, which is a continuation of application No. 17/144,930, filed on Jan. 8, 2021, now Pat. No. 11,230,425, which is a continuation of application No. 29/761,578, filed on Dec. 10, 2020, now Pat. No. Des. 966,903.

(51) Int. Cl.

| | |
|---|---|
| ***B65D 33/24*** | (2006.01) |
| ***B65D 33/04*** | (2006.01) |
| ***B65D 33/08*** | (2006.01) |
| ***B65D 77/04*** | (2006.01) |
| ***B65D 81/38*** | (2006.01) |
| *B65D 85/72* | (2006.01) |

(52) U.S. Cl.
CPC ..... *B65D 81/3888* (2013.01); *B65D 33/04* (2013.01); *B65D 33/08* (2013.01); *B65D 33/24* (2013.01); *B65D 77/04* (2013.01); *B65D 77/0406* (2013.01); *B65D 85/72* (2013.01)

(58) Field of Classification Search
CPC .... B65D 81/3888; B65D 33/04; B65D 33/08; B65D 33/24; B65D 77/04; B65D 77/0406; B65D 85/72
USPC ..... 383/110
See application file for complete search history.

(56) References Cited

U.S. PATENT DOCUMENTS 2,810,506 A * 10/1957 Kessler ..... B65D 5/2052 229/101
2,844,299 A * 7/1958 Kessler ..... B65D 5/46032 229/117.22

(Continued)

*Primary Examiner* — Peter N Helvey
(74) *Attorney, Agent, or Firm* — Nicholas Pfeifer; Smith & Hopen, P. A.

(57) ABSTRACT

An insulated retail packaging container, method of manufacturing the same, and a method of filling the container. An embodiment of the container includes a plurality of interconnected panels establishing a flexible waterproof insulated bag. A re-closeable seal is configured to temporarily close the bag creating an enclosable receiving compartment that contains a plurality of individually packaged cups. A thermally insulating lining is secured to a majority of an internal surface of the receiving compartment. Disposed within one of the pluralities of interconnected panels is a first viewing window. The first viewing window is comprised of a transparent material, thereby allowing a user to determine a state of the retail products housed within the insulated retail packaging container without having to open the re-closeable seal when the insulated retail packaging container is operating as a cooler.

20 Claims, 13 Drawing Sheets

(56) References Cited

U.S. PATENT DOCUMENTS 2,979,227 A * 4/1961 Taber ..... F25D 31/007 62/529
3,038,651 A * 6/1962 Cloudsley ..... B65D 75/5805 383/106
3,119,494 A * 1/1964 Rosenstiel ..... B65D 5/248 229/189
3,402,749 A * 9/1968 Gustav ..... B65D 33/08 383/63
4,328,923 A * 5/1982 Graser ..... B65D 5/0005 206/427
4,574,978 A * 3/1986 Hodges ..... B65F 1/06 206/427
5,020,337 A * 6/1991 Krieg ..... F25D 3/06 62/464
5,094,359 A * 3/1992 DeMars ..... B65D 5/0005 206/427
5,303,863 A * 4/1994 Arasim ..... B65D 81/36 229/101
5,495,727 A * 3/1996 Strong ..... B65D 81/18 229/101
5,582,343 A * 12/1996 Dalvey ..... B65D 5/42 229/101
5,788,378 A * 8/1998 Thomas ..... B65D 33/2508 53/133.4
6,033,114 A * 3/2000 Grimm ..... B65D 31/02 383/102
6,805,485 B2 * 10/2004 Hogan ..... B65D 33/2541 383/120
6,988,829 B2 * 1/2006 Bareis ..... B65D 33/04 383/106
7,419,300 B2 * 9/2008 Pawloski ..... B65D 33/10 383/14
7,806,314 B2 * 10/2010 Sutherland ..... B65D 71/36 206/427
D701,125 S * 3/2014 Propper ..... D9/709
8,911,339 B2 * 12/2014 De Paula ..... B65D 5/5415 229/101
9,382,043 B2 * 7/2016 Rummo ..... B65D 33/1691
10,583,964 B2 * 3/2020 Troost ..... B65D 33/2541
11,230,425 B1 * 1/2022 Block ..... B65D 33/04
2002/0134698 A1 * 9/2002 Rhodes ..... B65D 5/542 206/477
2002/0134827 A1 * 9/2002 Sinclair ..... B65D 5/6664 229/103
2003/0041564 A1 * 3/2003 Schmidt ..... B65B 61/188 53/134.1
2003/0232112 A1 * 12/2003 Whitmore ..... B65D 43/021 426/108
2004/0076347 A1 * 4/2004 Johnson ..... B65D 31/04 383/106
2004/0120613 A1 * 6/2004 Hanson ..... B65D 33/08 383/103
2005/0135712 A1 * 6/2005 Barbier ..... B65D 33/25 383/66
2006/0228058 A1 * 10/2006 Watterott ..... B31B 70/83 383/125
2007/0036473 A1 * 2/2007 Nagata ..... B31B 70/008 383/121.1
2008/0063318 A1 * 3/2008 Gattino ..... B65D 81/3876 383/21
2008/0240622 A1 * 10/2008 Bell ..... B65D 33/00 383/5
2008/0240626 A1 * 10/2008 Bell ..... B65D 31/10 53/396
2011/0041521 A1 * 2/2011 Kessler ..... F25D 3/06 62/62
2011/0268372 A1 * 11/2011 Brauer ..... B65D 33/08 493/243
2013/0142454 A1 * 6/2013 Simmonite ..... B65D 31/10 383/1
2014/0212068 A1 * 7/2014 Yu ..... B65D 75/008 383/7
2014/0248005 A1 * 9/2014 David ..... B65D 75/008 383/104
2015/0110423 A1 * 4/2015 Fox ..... B65D 33/1625 383/117
2016/0083161 A1 * 3/2016 Moriz ..... B65D 75/008 383/104
2016/0347527 A1 * 12/2016 Hartley ..... B31B 70/81
2017/0144792 A1 * 5/2017 Block ..... B65D 25/30
2017/0320632 A1 * 11/2017 Beer ..... B65B 43/06
2019/0328019 A1 * 10/2019 Green ..... A23D 9/04

* cited by examiner

ARTICLE CARRIER WITH INTEGRATED COOLER AND METHOD OF MANUFACTURING

CROSS-REFERENCE TO RELATED APPLICATIONS

This nonprovisional application is a continuation of and claims priority U.S. nonprovisional application Ser. No. 17/567,604, entitled "ARTICLE CARRIER WITH INTEGRATED COOLER AND METHOD OF MANUFACTURING," filed Jan. 3, 2022 by the same inventor(s), which is a continuation of and claims priority to U.S. nonprovisional application Ser. No. 17/144,930, now U.S. Pat. No. 11,230,425, entitled "ARTICLE CARRIER WITH INTEGRATED COOLER AND METHOD OF MANUFACTURING," filed Jan. 8, 2021 by the same inventor(s), which claims priority to design application Ser. No. 29/761,578, now U.S. Pat. No. D966,903, entitled "Design of retail packaging for consumable products," filed Dec. 10, 2020 by the same inventor(s).

BACKGROUND OF THE INVENTION

1. Field of the Invention

This invention relates, generally, to retail packaging. More specifically, it relates to retail packaging for consumable products.

2. Brief Description of the Prior Art

Traditionally, retail packaging for consumable products have been designed with a primary focus on reducing costs. To do so, particular focus is place on the footprint of the retail packaging. Ultimately, the goal is to reduce the footprint of the products within the packaging to thereby reduce the footprint of the packaging when filled with products. Reducing the footprint of the filled packaging reduce costs associated with manufacturing the packaging (smaller size equals less material, which equals less costs), storage of the filled packaging, and transportation of the filled packaging.

Retail packaging has also historically been unable to also operable as a cooler. Again, the costs associated with modifying the packaging to also act as a cooler acted as a deterrent. The retail packaging would inherently become larger and require expensive insulating materials. In particular, traditional retail packaging contain the following limitations: (1) they are not airtight or engineered in a leak-proof format, (2) they lack an insulative layer to thermally insulate the contents, (3) (4) they lack the ability to see the contents of the packaging without having to open the packaging, (5) they lack suitable handles to support the weight of the contents with added ice and water and (6) they do not lend themselves to high-speed automation (e.g., the size of the individually sealed packages relative to the opening of the retail packages preclude certain shapes and sizes of traditional retail packaging.

There have been attempts to create an insulated retail packaging, such as U.S. patent application Ser. No. 16/632,760 ("the '760 application"). However, the retail packaging disclosed therein again focuses on reducing the footprint of the packaging. Specifically, the '760 application discloses "a canned beverage bag assembly that is configured to contain a number of cans in a box shape during transit, storage, and sale and which can be converted to a portable cooler configured to receive ice for cooling the cans contained therein. The shape of the convertible beverage container package allows a compact package for storage and transport." Moreover, the "retail state" of the packaging in the '760 application includes the packaging tightly folded around the canned beverages which are neatly oriented in an organized fashion to "provide a stable package" and prevent the cans from toppling. While this approach undoubtedly reduces the footprint of the retail state of the packaging, it has adverse effects on the ability of the packaging to cool the tightly packed beverages.

Accordingly, what is needed is an improved retail packaging and method of manufacturing which provides greater cooling capabilities, due to more exposed surface area. In addition, there is a need for an improved method of filling this improved retail packaging to reduce the costs associated with the filing process to offset other costs related to the storage, transportation, and additional materials of the improved retail packaging.

Furthermore, there is a need to provide a means, and method of manufacturing the same, to see the state of the contents without opening the seal and allow the cooler air to escape when operating as a cooler. This is especially true when the contents of the retail packaging are individually sealed gelatinous consumable products. Focusing on these gelatinous products for a moment, they must be cooled to a certain temperature to solidify. Thus, there is a need for an insulating container that allows a user to view the state of the gelatinous consumable products without having to open the container and compromise the cooling capabilities of the container.

However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an insulated retail packaging container having an integrated cooler is now met by a new, useful, and nonobvious invention.

The novel structure includes an insulated retail packaging container comprising a plurality of interconnected panels that establish a flexible waterproof bag capable of containing water and/or ice without leaking. In some embodiments, the plurality of interconnected panels includes a bottom panel, a front panel, and two side panels that extend upwardly from the bottom panel. Each side panel resides at least partially between the front and back panels.

An opening resides at an upper end of the bag and allows the insulated retail packaging container to be filled with retail products and then permanently sealed for distribution and ultimately retail sales. The opening is sufficiently sized and shaped to receive a predetermined number of retail products of a predetermined size to avoid bridging when the products are freely deposited into the retail packaging container.

In an embodiment, the insulated retail packing container further includes a manufacturing seal that joins the front panel to the back panel. The insulated retail packaging container further includes a re-closeable seal configured to temporarily close the bag creating an enclosable receiving compartment. The manufacturing seal resides above the re-closeable seal and permanently seals the filled retail packaging bag until the manufacturing seal is cut, torn, or removed from the filled retail packaging container.

The manufacturing seal is typically above a tear strip feature, which is comprised of a die-cut or impressed or perforated line for consistent opening of the insulated retail packaging post purchase. That tear strip feature is commonly book-ended by tear notches on both sides that promote the ease of opening the insulated retail packaging with a simple shear force. For automation purposes, the tear strip feature is around 10-25 millimeters from the top of the retail packing container to provide a margin of error for automation equipment and give enough area above the tear strip feature to seal the retail packing container.

In some embodiments, the re-closeable seal has a first engagement member on the front panel proximate to the upper end of the front panel and a second engagement member disposed on the back panel proximate to the upper end of the back panel. The first and the second engagement members are configured to engage with each other temporarily.

In addition, a thermal insulating lining is secured to at least a majority of an internal surface of the enclosable receiving compartment. In some embodiments, a handle is established by a through-hole disposed through the front and back panels and resides above the re-closeable seal. When the handle is a through-hole, the handle resides above the re-closeable seal to maintain the waterproof nature of the waterproof bag.

Some embodiments include a first viewing window disposed within one of the pluralities of interconnected panels. The first viewing window is comprised of a transparent material, thereby allowing a user to determine a state of the retail products housed within the insulated retail packaging container without having to open the re-closeable seal when the insulated retail packaging container is operating as a cooler. In some embodiments, the first viewing window is disposed on the front panel and a second viewing window is disposed on a back panel. In less common cases, viewing windows can be incorporated into pouch side panels. In all such embodiments, the thermal insulating lining does not cover the first and second viewing windows.

Some embodiments include a plurality of individually packaged containers/cups containing a gelatinous product residing within the receiving compartment in a freely disposed, unorganized manner, thereby allowing added ice and water to sufficiently surround each of the cups. In some embodiments, each of the individually gelatinous products is transparent, thereby permitting a user to determine if the gelatinous products are in a liquid state or a gel state by viewing the gelatinous products through the first viewing window, the transparent cup and, where applicable, the second viewing window.

Some embodiments of the present invention include a method of packaging a gelatinous consumable product. The method comprises the steps of providing a plurality of individually sealed cups, each containing a gelatinous consumable product, and one or more empty retail packaging bags. Each of the provided empty retail packaging bags may coincide with the various embodiments described herein.

In the next step, at least one of the empty retail packaging bags is inserted into a production line. The empty retail packaging bag is then opened by separating the upper ends of the front and back panels and inserting a funnel into the opening. A predetermined number of the individually sealed cups are freely delivered into the funnel in an unorganized manner, such that the individually sealed cups are freely disposed in the receiving compartment resulting in a filed retail packaging bag. Lastly, the production opening is closed by securing the front panel to the back panel of the filled retail packaging bag using a manufacturing seal.

In an embodiment, the method further includes the steps of manufacturing the empty retail packaging bags. The steps of manufacturing the empty retail packaging bags includes applying a water-soluble agent onto an internal surface of a predetermined panel at an intended location of a viewing window. The thermal insulating layer is then applied to the internal surface of the predetermined panel. The internal surface of the predetermined panel is then rinsed within a water-based solution. Interaction of the water-based solution with the water-soluble agent allows a section of the thermal insulating layer at the intended location of the viewing window to be removed, thereby creating a first viewing window. In an embodiment, manufacturing the empty retail packaging bag further includes interconnecting the plurality of panels once the panels are dried.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1A:
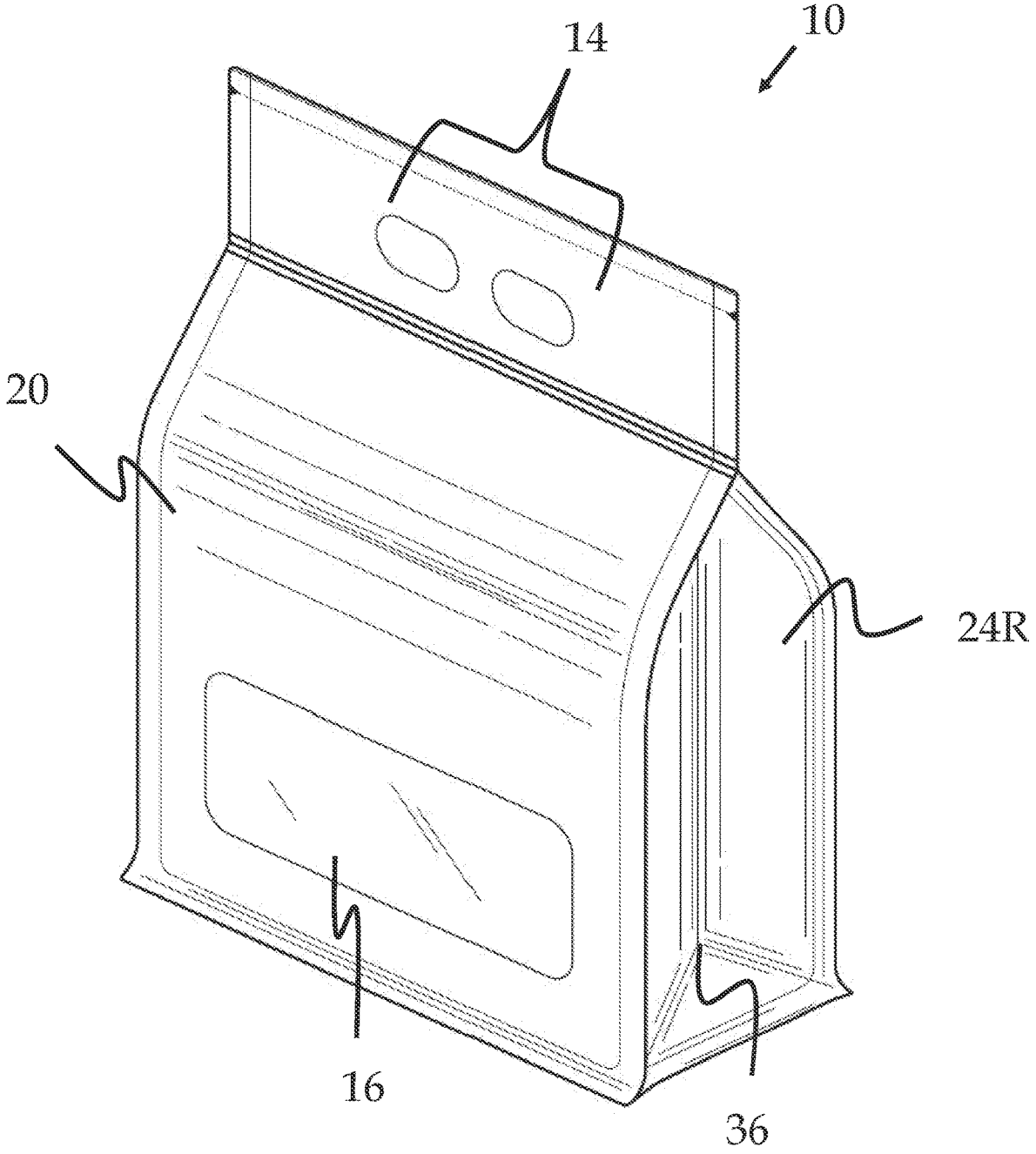
FIG. 1A is a perspective view of an embodiment of the retail packaging bag.
Figure 1B:
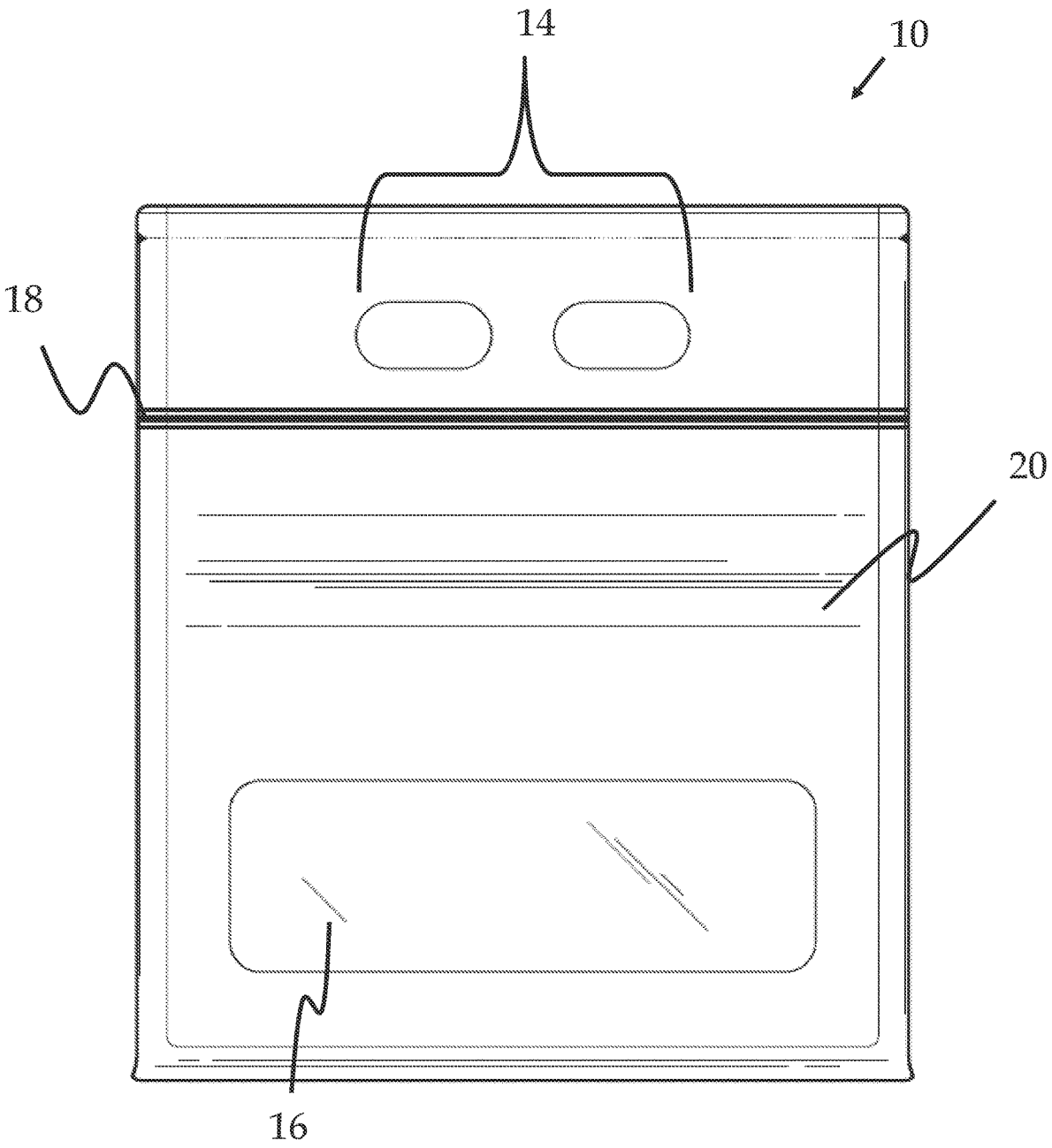
FIG. 1B is a frontal view of an embodiment of the retail packaging bag.
Figure 1C:
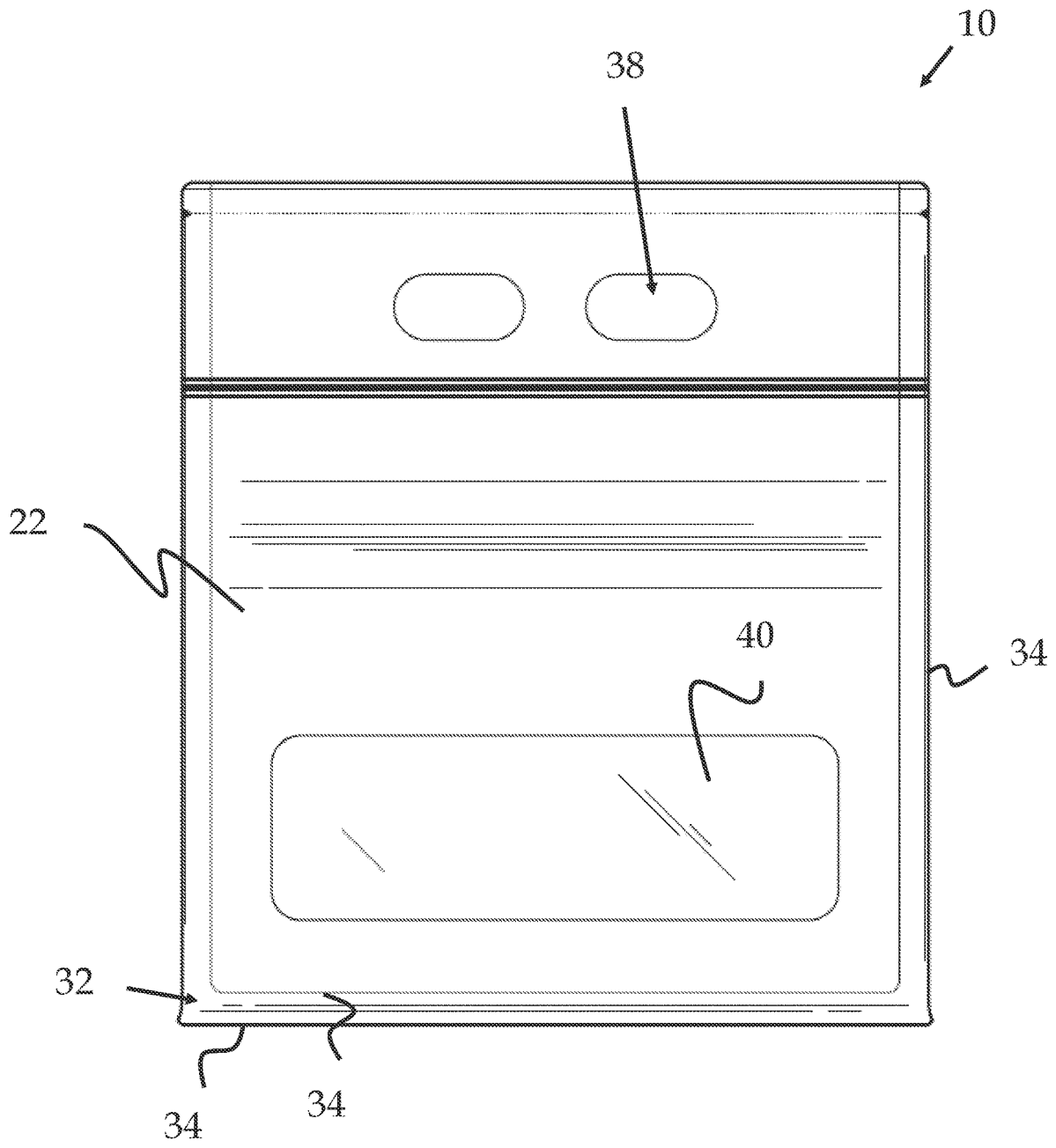
FIG. 1C is a rear view of an embodiment of the retail packaging bag.
Figure 1D:
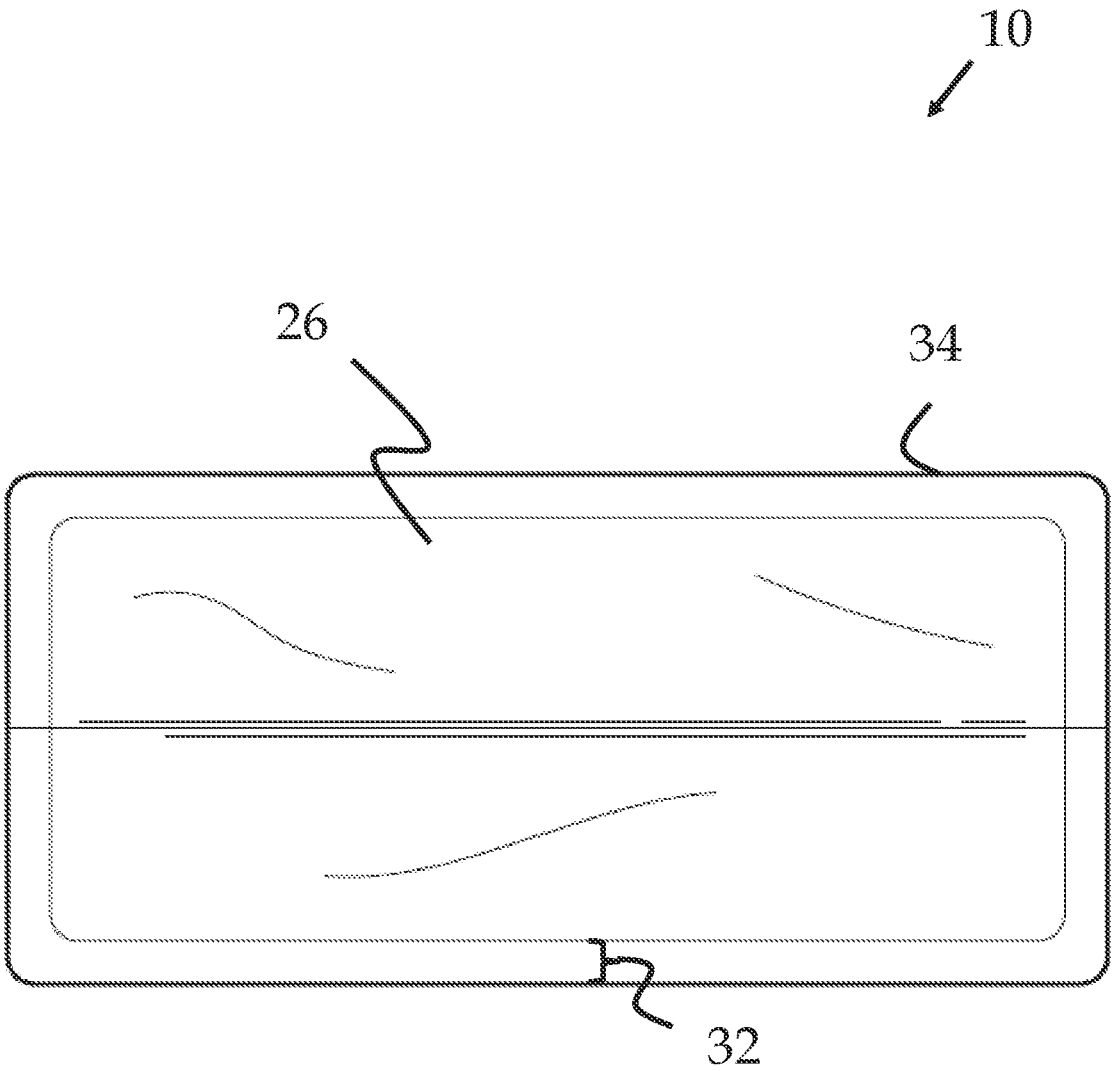
FIG. 1D is a bottom view of an embodiment of the retail packaging bag.
Figure 1E:
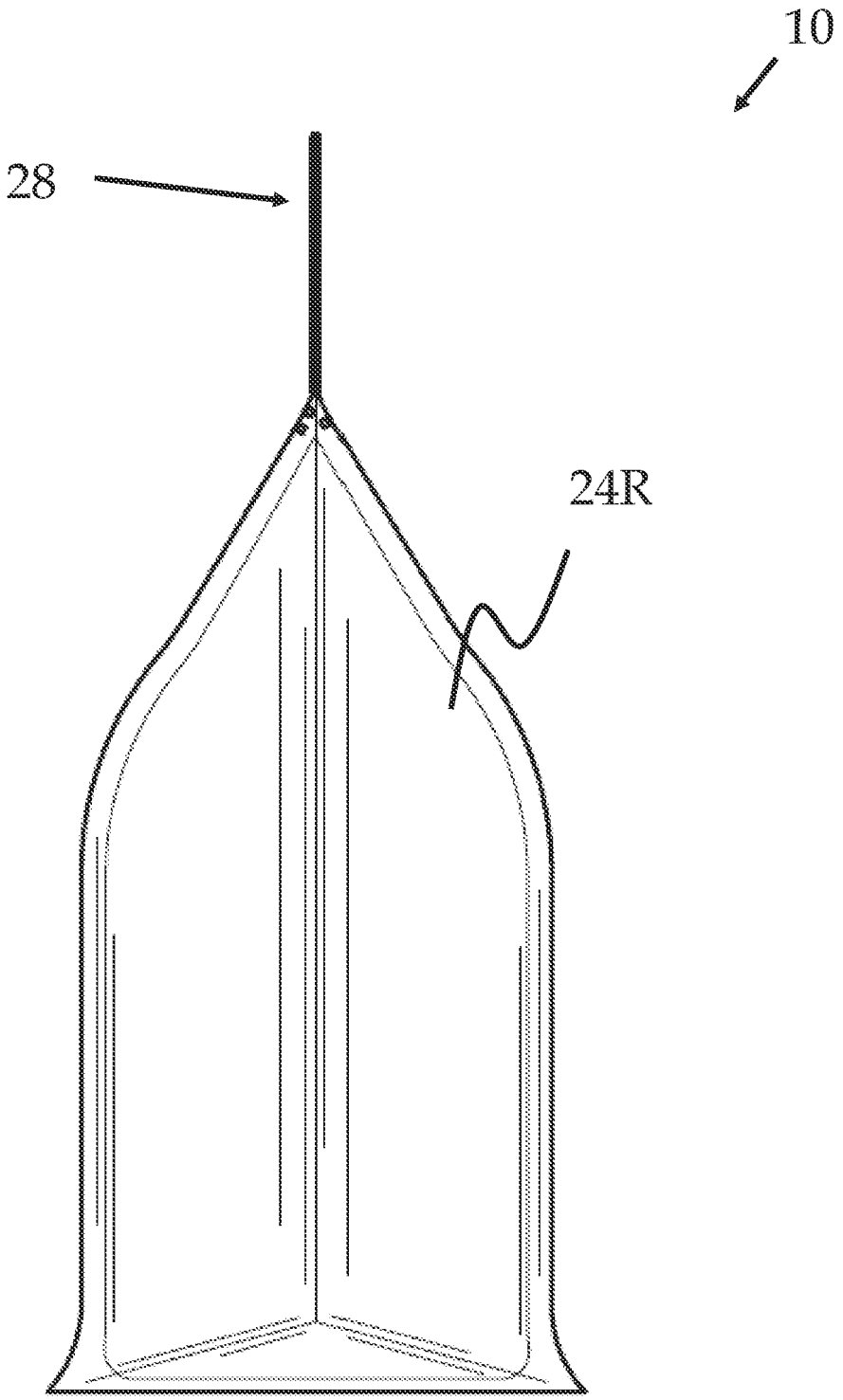
FIG. 1E is a side view of an embodiment of the retail packaging bag.
Figure 1F:
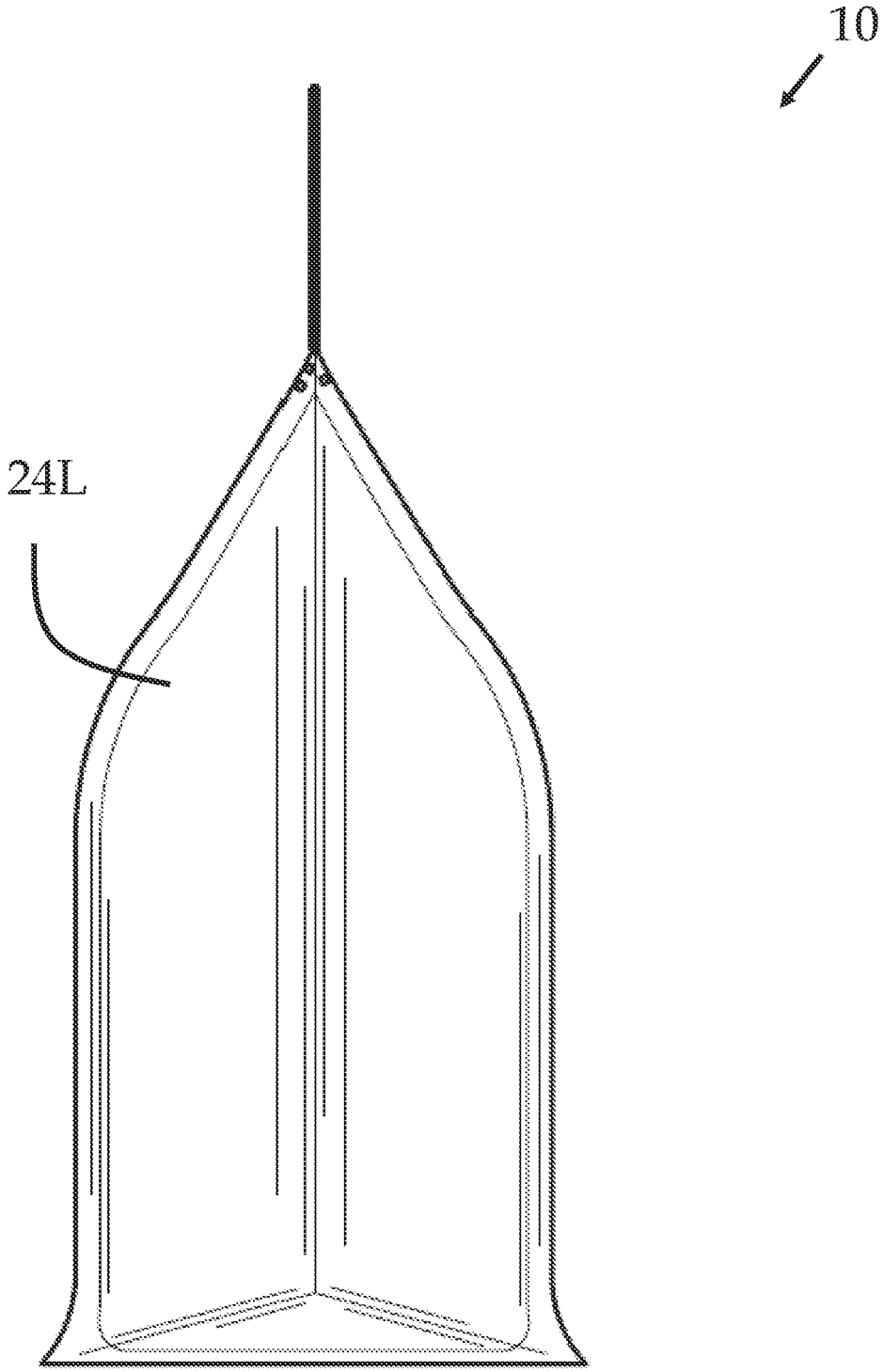
FIG. 1F is an alternative side-view of an embodiment of the retail packaging bag.

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The phrases "in some embodiments," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

The present invention includes an insulated retail packaging bag, a method of manufacturing the same, and a method of preparing the insulated retail packaging bag for retail distribution. The insulated retail packaging bag is configured to receive individually packaged consumable products prior to being sealed for retail distribution. Once purchased, a manufacturing seal can be torn away or unsealed to allow a consumer to fill the insulated retail packaging bag with water and ice. As a result, the insulated retail packaging bag becomes a portable waterproof cooler.

Accordingly, some embodiments of the insulated retail packaging bag include several watertight seams to preventing leaking. In addition, these seams are configured to support the weight of the contents enclosed within the bag. Because the bag is expected to hold the retail contents and added ice and water, some embodiments of the insulated retail packaging bag are adapted to hold weight in excess of 9 lbs.

The insulated retail packaging bag may be constructed from a flexible material, such as plastic, vinyl, or nylon, and configured to accommodate the shape of the contents disposed within the receiving compartment. In some embodiment, the insulated retail packaging bag may similarly be constructed from heavy duty plastics, such as polypropylene (PP), polyethylene (PE), polyethylene terephthalate (PET), high-density polyethylene (HDPE), or polystyrene (PS). Furthermore, to be environmentally or eco-friendly, the insulated retail packaging bag may be recyclable and/or biodegradable. In some embodiments, the material may be sufficiently durable to permit the reusability of the packaging over a prolonged period for carrying contents within the receiving compartment.

The insulated retail packaging bag is of a sufficient size to allow a predetermined number of individually packaged consumable products, preferably shot-sized individually portioned cups, to reside within the receiving compartment. The size of the bag is dependent on the number of products sold in the bag. An exemplary width of the bag ranges from 6 inches to 24 inches. An exemplary depth of the bag ranges from 2.5 inches to 8 inches, and exemplary height ranges from 4 inches to 24 inches. Some embodiments of the bag include 8 individually portioned cups and a width of roughly 8.25 inches, a depth of roughly 2.75 inches, and a height of roughly 9.5 inches. Some embodiments of the bag include 24 shot-sized cups and a width of roughly 11 inches, a depth of roughly 5.25 inches, and a height of roughly 13 inches. These size ranges ensure adequate volume within the receiving compartment to properly cool the products while also having optimal external sizes for manufacturing, shipping, storage, and retail display on shelf.

In some embodiments, the insulated retail packaging bag houses individual sealed consumables, such as gelatin shots, liquor shots, cupped beverages, etc. In addition, some embodiments of the insulated retail packaging bag are configured to hold various quantities of consumable products. For instance, the insulated retail packaging bag may be configured to hold six individually portioned cups, twelve, twenty-four, or any other number of individually portioned cups. For the sake of simplicity, the embodiments disclosed herein are described as being configured to hold individually sealed gelatinous consumable products.

Accordingly, in some embodiments, the insulated retail packaging bag houses a plurality of cups containing gelatinous consumable products. These gelatinous consumable products can be stored in individual containers and can be freely disposed within a receiving compartment of the insulated retail packaging bag. Distributing the cups in an individually freely disposed manner saves time and money during the filling and packaging process. Freely distributing individual containers also allows for added water and ice to surround the individual cups more effectively to more efficiently cool the contents of the cups.

Moreover, in some embodiments, the individual cups may be comprised of a squeezable/pliable plastic-based material that allows the consumer to squeeze the gelatin from the cups. However, pliable plastic-based materials have less thermal conductivity than the more rigid metal-based materials, such as aluminum, used for canned beverages. As a result, the cups need to be sufficiently spaced within the receiving compartment of the insulated retail packaging bag to ensure that added ice and water can surround the individual cups to more efficiently cool the contents of the cups. If the individual cups were neatly stacked in a manner similar to the canned beverages in the '760 application, the individual cups of the gelatinous consumable products would take substantially longer to cool because of the lack of accessible surface area combined with their less efficient thermal conductivity.

In some embodiments, the insulated retail packaging bag includes one or more transparent windows. In addition, the cups containing the gelatinous consumable products may be transparent. Thus, a consumer can easily determine when the gelatinous consumable products are sufficiently cold to transition from a liquid state to a gel state without having to open the insulated retail packaging bag and release the cold air.

FIGS. 1A-1F depict insulated retail packaging bag 10 (hereinafter "bag 10"), which includes a plurality of interconnected panels. Bag 10 further comprises handle 14, first viewing window 16 disposed within one or more interconnected panels, and re-closeable seal 18. The interconnected panels include front panel 20, back panel 22, left-side panel 24L, and right-side panel 24R extending upwardly from bottom panel 26 toward upper end 28. Left-side panel 24L and right-side panel 24R reside at least partially between front panel 20 and back panel 22 to define receiving compartment 30.

The interconnected panels may be collectively manufactured from a single sheet of material or manufactured separately and then joined together. In any event, the interconnected panels may be manufactured via laminating, heat-sealing, coating, layering, melting, folding, gluing, and/or other suitable manufacturing methods for constructing the interconnected panels.

Outer seam 32 is formed along perimeter edge 34 of at least a portion of each of the interconnected panels. Outer seam 32 includes a minimum tolerance of between 5 mm and 30 mm from perimeter edge 34. More preferably, outer seam 32 tolerances can be between 10 mm and 20 mm from perimeter edge 34. Most preferably, outer seam 32 tolerances can be about 15 mm from perimeter edge 34.

Outer seams 32 may be established by any methods known by a person of ordinary skill in the art for bonding two edges to create a seam, including but not limited to heat-sealing and gluing. Outer seams 32 are preferably watertight seals.

Some embodiments of bag 10 include gussets 36 configured to permit bag 10 to be self-standing and prevent bridging of bag 10 during the filling process. These gussets may be any configuration known to a person of ordinary skill in the art that result in a free-standing bag.

Figure 2:
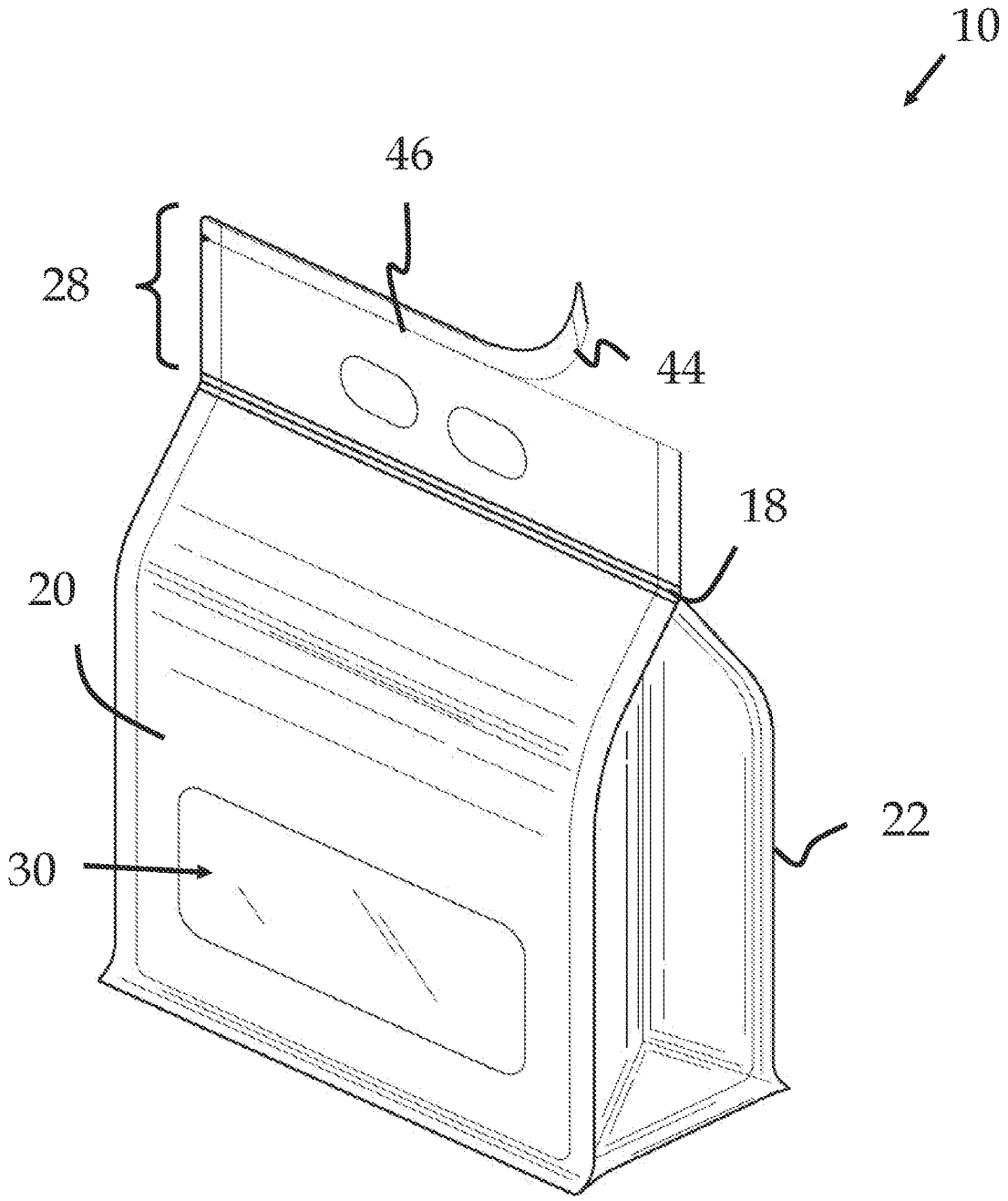
FIG. 2 is a perspective view of an embodiment of the retail packaging bag showing the tearaway portion partially removed from the retail packaging bag.

As best show in FIG. 2, an embodiment of bag 10 includes manufacturing seal 44 at upper end 28. Manufacturing seal 44 is formed once bag 10 has been filed with the desired contents and is of a type that provides a permanent seam once formed. Manufacturing seal 44 not only seals receiving compartment 30 from the external environment, but also may provide a visual check (or que) to identify and prevent tampering with contents disposed within bag 10. In particular, if manufacturing seal 44 is broken or unsealed, it provides a visual signal or alert to the person that the contents secured within receiving compartment 30 may have been tampered with.

Bag 10 further includes re-closeable seal 18 disposed proximate upper end 28. Re-closeable seal 18 resides below manufacturing seal 44 to protect re-closeable seal 18 from unnecessary wear and tear as of the result of being exposed to the external environment. Re-closeable seal 18 is configured to temporarily seal (i.e., close) receiving compartment 30.

In some embodiments, re-closeable seal 18 is formed integrally with a portion of bag 10 and permits the bag to transition from an open configuration (see FIG. 3A) to a closed configuration (see FIG. 1A). More specifically, re-closeable seal 18 includes first engagement section 18A disposed on front panel 20 and second engagement section 18B disposed on back panel 22. In an embodiment, re-closeable seal 18 may be a press-fitting mechanism, hook and loop, clamp, protrusion and complementary receipt, magnetic couplings, adhesive, or any other mechanism that enables the person to transition bag 10 from a closed position to an open position at will.

Bag 10 also includes handle 14 residing above (or more proximal to) upper end 28 than re-closeable seal 18. Handle 14 is established by one or more through-holes 38 disposed through front panel 20 and through a corresponding portion of back panel 22. Through-hole(s) 38 are sized to receive one or more fingers, or a hand, of a user, such that the user can easily carry bag 10. However, through holes 38 are smaller than the individual cups to ensure that the cups cannot be removed through those handle holes. In an embodiment, handle 14 or the area immediately surrounding handle 14 may be reinforced with additional layers of material to provide additional structural support and/or additional comfort when carrying bag 10. In some embodiments, handle 14 is comprised of a graspable strap or any other type of handle known to a person of ordinary skill in the art.

In some embodiments, bag 10 include first viewing window 16. Viewing window 16 resides at a location adjacent to the receiving compartment in which the consumable products are stored. In some embodiments, viewing window 16 resides in the lower half of bag 10 to ensure that the consumable products are visible to the consumer.

Some embodiments include a second viewing window 40 formed within the same or separate interconnected panel than first viewing window 16. In some embodiments, first viewing window 16 resides on front panel 20 and second viewing window resides on back panel 22. In some embodiments, first viewing window 16 resides on a panel opposite to the panel on which second viewing window resides. In any case, each of first viewing window 16 and second viewing window 40 permit the user to view receiving compartment 30 formed within bag 10 to analyze the contents that may reside therein.

Each of first viewing window 16 and second viewing window 40 are comprised of transparent material that allows the user to visually inspect receiving compartment 30 and any contents that may be contained therein. Non-limiting examples of transparent material include plastic, glass, epoxy, transparent ceramics, acrylic, and/or any other material capable of permitting the user to visually inspect receiving compartment 30, while at the same time not compromising the ability of receiving compartment 30 to be sealed from the external environment. In some embodiments, the viewing windows are comprised of lightweight, inexpensive transparent plastic materials.

Figure 3A:
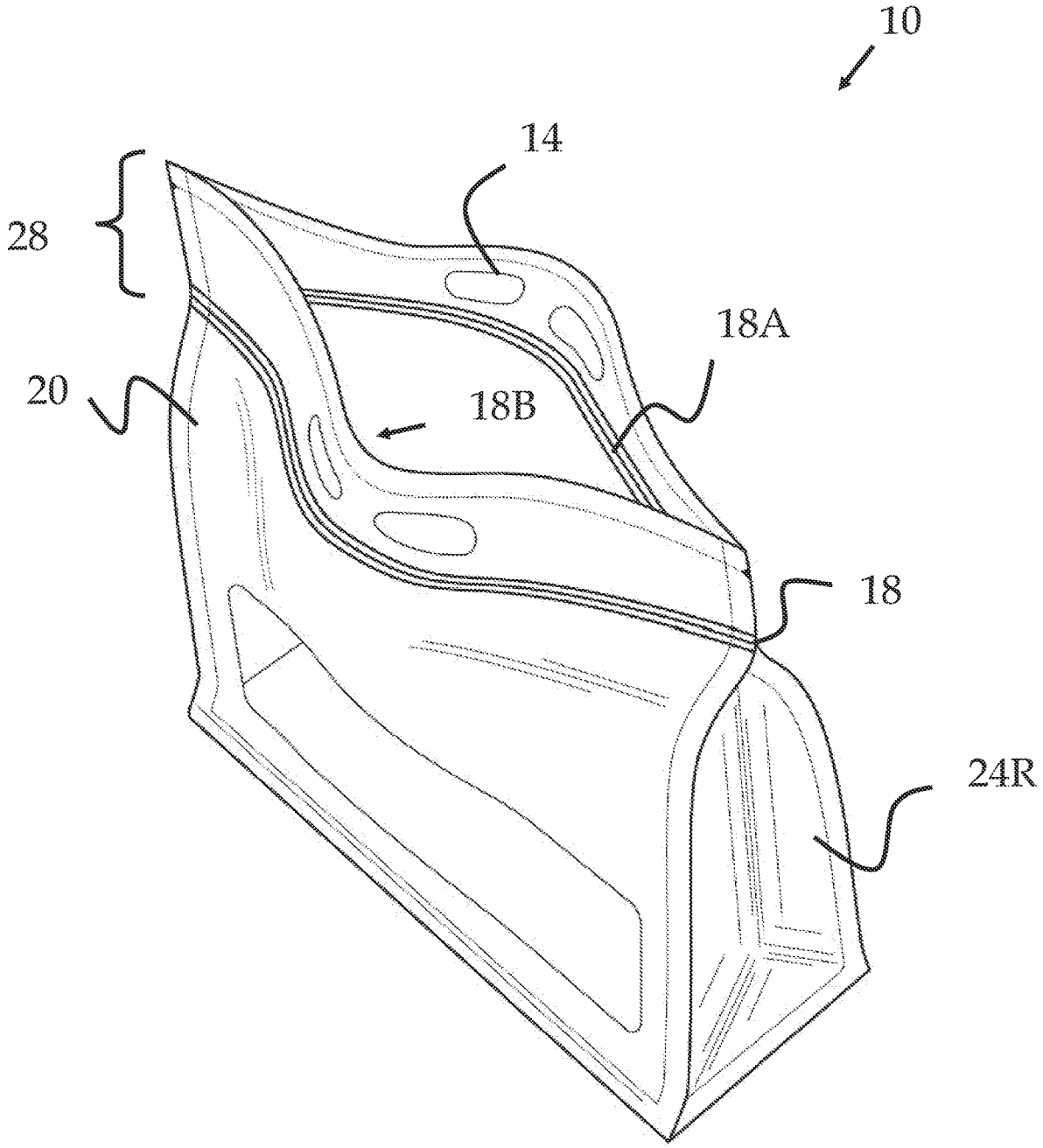
FIG. 3A is a top perspective view of an embodiment of the retail packaging bag in the open configuration.
Figure 3B:
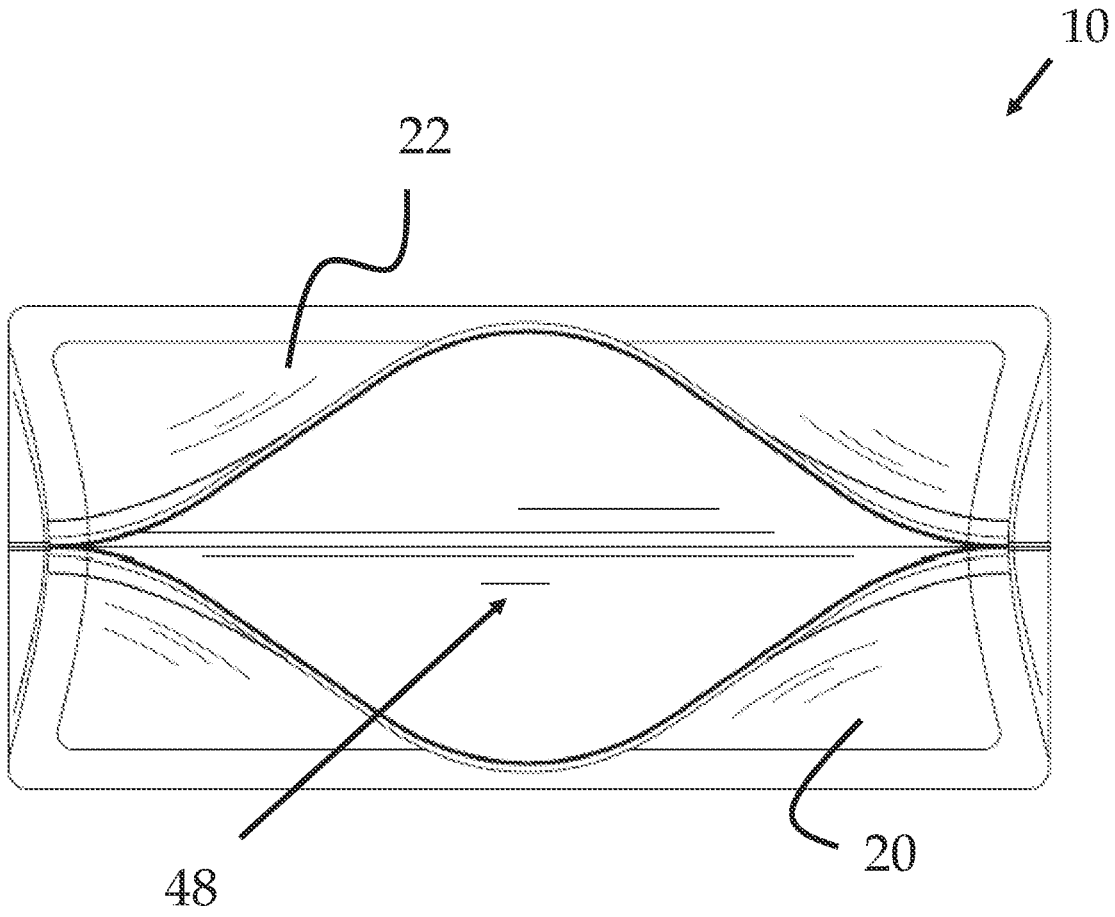
FIG. 3B is a top view of an embodiment of the retail packaging bag in the open configuration.

Referring now to FIGS. 3A and 3B, bag 10 includes an open configuration for receiving product. Specifically, opening 48 is defined by upper end 28 and provides access to receiving compartment 30. When in the open configuration, a portion of front panel 20 containing first engagement section 18A is spaced apart from a portion of back panel 22 containing second engagement section 18B, such that first engagement section 18A is uncoupled from second engagement section 18B, thereby forming opening 48 and providing access to receiving compartment 30 through opening 48.

Bag 10 also includes a closed configuration. In the closed configuration, first engagement section 18A is mechanically engaged with second engagement section 18B. Such engagement of first engagement section 18A with second engagement section 18B forms an internal environment within receiving compartment 30 isolated from the external environment. Moreover, the sealed internal environment provides a thermal barrier to the external environment, thereby enabling the contents disposed within receiving compartment 30 to retain their temperature for a longer time than if exposed to the external environment.

Figure 4:
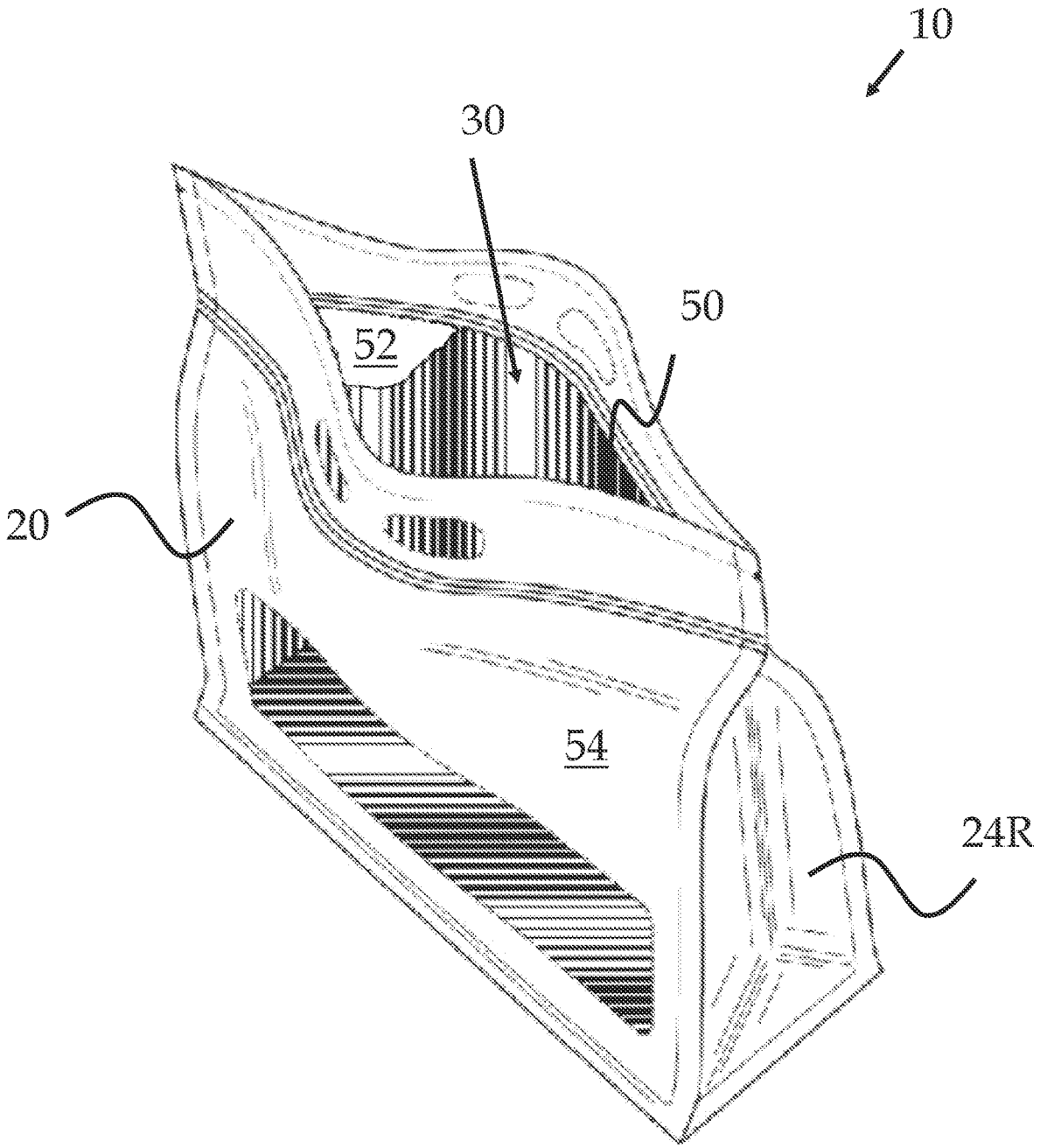
FIG. 4 is a top perspective view of an embodiment of the insulated retail packaging bag in the open configuration showing the thermal insulating lining.

The thermal barrier is best shown in FIG. 4, which depicts bag 10 in the open configuration with one or more layers of thermal insulative lining 50 within receiving compartment 30. Thermal insulative lining 50 is secured to at least a majority of internal surface 52 of receiving compartment 30. In an embodiment, thermal insulative lining 50 is hidden behind internal surface 52, between internal surface 52 and external surface 54 of interconnected panels 12. Such placement of thermal insulative lining 50 prevents damage (e.g., ripping, tearing, or scratching) during the normal use of bag 10 (i.e., the repeated insertion and removal of contents or other objects within receiving compartment 30).

In use, the one or more layers of thermal insulative lining 50 provide a thermal barrier between the interior environment of receiving compartment 30 and an external environment, such that the contents received within receiving compartment 30 retain their temperature for a longer period of time then if they were exposed to the external environment. Additionally, thermal insulative lining 50 may have a measurable thickness or may alternatively be comprised of a single layer of insulating material having a minimum thickness depending on which type and how much insulation is desired.

Moreover, embodiments of thermal insulative lining 50 may be constructed from any number of thermal insulative materials, including, but not limited to gold foil insulation, aluminum foil insulation, silver foil insulation, adhesive-backed insulation, thermal insulation, double bubble insulation, bubble insulation, insulated box lining insulation, reflective foil insulation, foam insulation, fire retardant foil insulation, or any other type of insulation that retards a change in temperature of the internal environment when bag 10 is in the closed configuration. Furthermore, thermal insulative lining 50 is manufactured via laminating, heat-sealing, coating, layering, melting, folding, gluing, and/or other suitable methods for constructing one or more thermal layers insulative lining 50 using one or more types of thermal insulative materials. In an embodiment, thermal insulative lining 50 is comprised of a "metal" foil to reduce material costs and simplify manufacturing.

Figure 5:
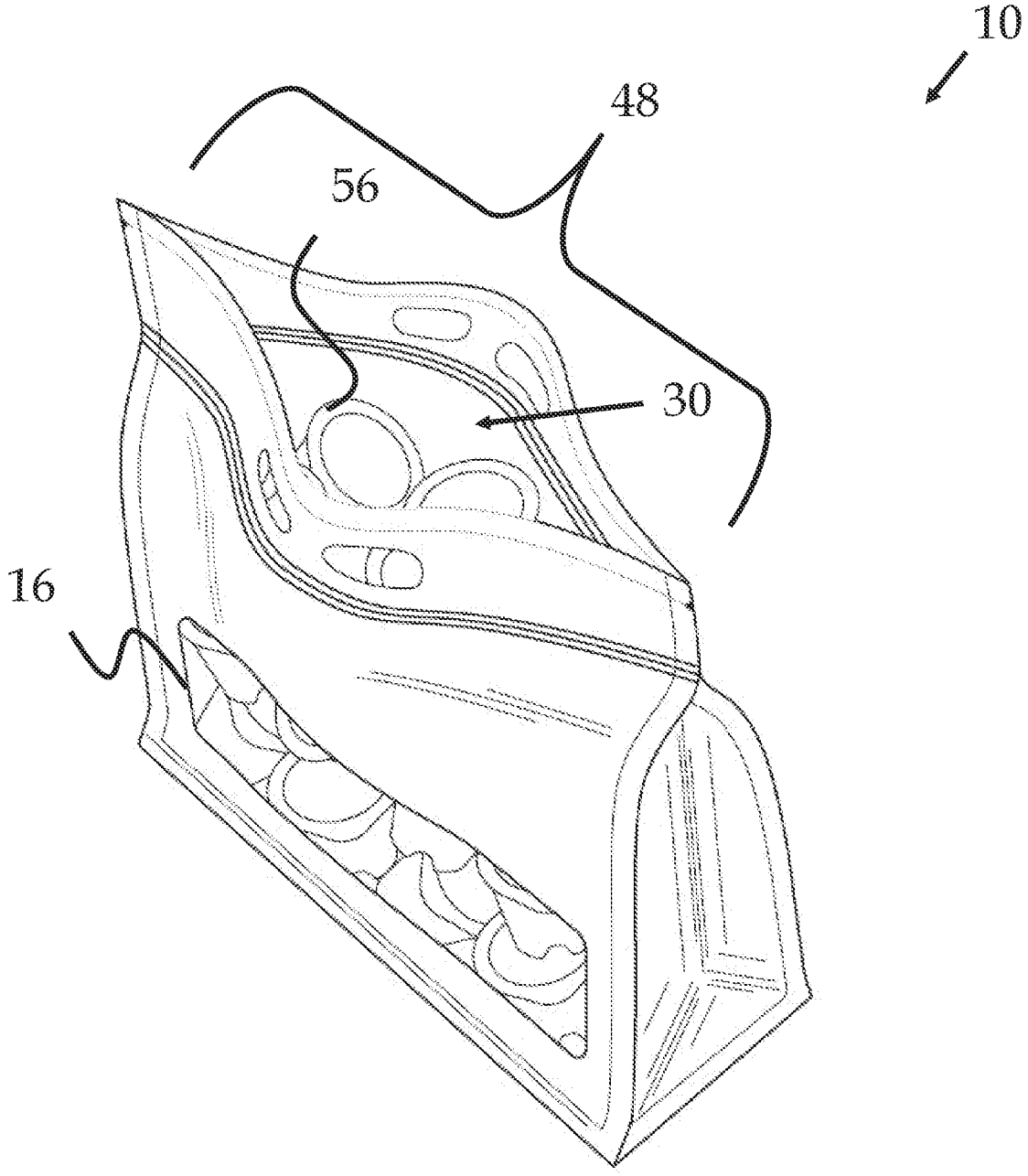
FIG. 5 is a top perspective view of an embodiment of the insulated retail packaging bag in the open configuration having a plurality of insulated cups disposed within the receiving compartment.

FIG. 5 depicts a perspective view of bag 10 in an open configuration having a plurality of individually packaged cups 56 (hereinafter "cups 56"). Each cup 56 includes a body defining a cavity configured to receive a consumable product. In an embodiment, the edible product is a gelatinous alcohol infused product that must be chilled to a certain temperature to transition from a liquid state to a gel state.

The squeezable cup 56 is generally made of a material that permits cup 56 to be deformed without breaking. Cup 56 may also be comprised of a transparent material, thereby allowing a consumer to visually identify when the gelatinous consumable reaches a gel state. In an embodiment, the cup material may be a plastic, such as polypropylene (PP), polyethylene terephthalate (PET), high-density polyethylene (HDPE), and polystyrene (PS); however, it is appreciated that any number or combination of materials may be used to provide rigidity and support to cups while at same time permitting the user to see the state of the contents contained within the cavity. In an embodiment, polypropylene may be selected for its health (e.g., BPA free), safety (e.g., food grade), pliability (e.g., elasticity coefficient), and environmental characteristics (e.g., recyclable). In any case, the material is preferably transparent to permit the user to determine the state of the edible product when looking through the viewing windows in the bag.

Cups 56 have a cross-sectional shape that is generally circular in shape; however, it is appreciated that any number of cross-sectional shapes may be used including, but not limited to, square, oval, rectangular, heptagonal, hexagonal, pentagonal, etc. To prevent the edible product from being contaminated by either the internal or external environment and prevent the edible product from being prematurely removed, cups 56 include a cap. In an embodiment, each cup 56 has a capacity of about 30 mL to 130 mL. In some embodiments, cup 56 has a capacity of about 40 mL to 100 mL. In some embodiments, cups 56 have a capacity of about 60 mL to conform with Alcohol and Tobacco Tax and Trade Bureau requirements for standard sizes.

In an embodiment, opening 48 of bag 10 is proportional to the size of cup 56 to prevent the cups from bridging when deposited into bag 10. For example, if cup 56 has a cross-sectional diameter of 2.15 inches, the proportional size of opening would be roughly 8 inches when dropping 8 cups at a time within receiving compartment 30. In an embodiment, the size of opening 48 is similarly proportional to the number of cups being dropped within receiving compartment 30 and their relative angle to opening 48. In any case, cups 56 are disposed within receiving compartment 30 in a freely disposed, unorganized manner which allows one or more cooling agents (e.g., ice and water) to sufficiently surround each cup 56. In addition, delivering cups 56 into receiving compartment 30 in a freely disposed, unorganized manner significantly reduces the difficulty and expense with uniformly organizing cups 56 within receiving compartment 30.

Figure 6:
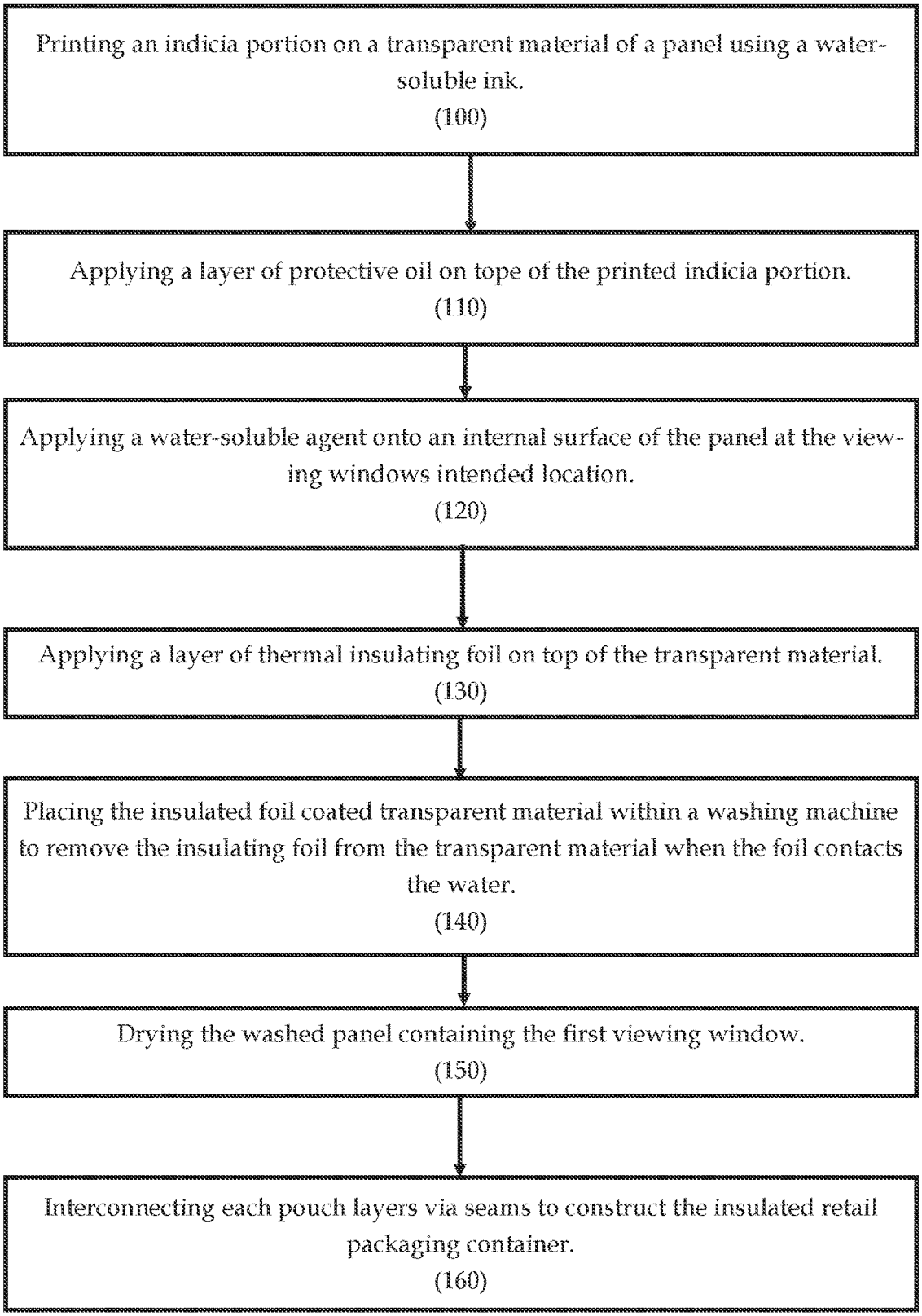
FIG. 6 is an exemplary process-flow diagram of an embodiment of the method of manufacturing the insulated retail packaging container.
Figure 7:
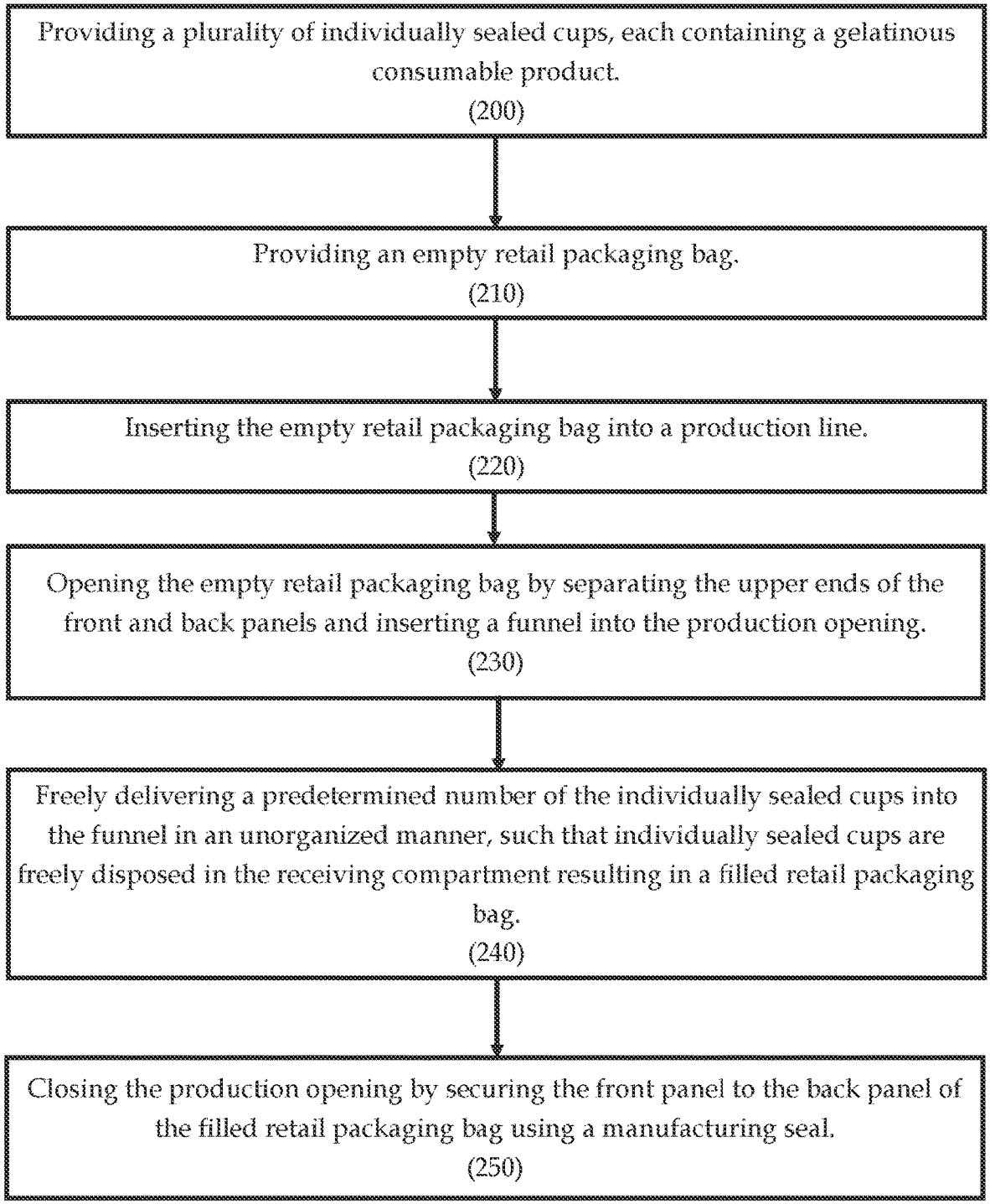
FIG. 7 is an exemplary process-flow diagram of an embodiment of the method of packaging a retail packaging bag containing a plurality of gelatinous consumable products.

Referring now to FIG. 6, in conjunction with FIGS. 1-5, an exemplary process-flow diagram is provided, depicting a method of manufacturing an insulated retail packaging container. The steps delineated in the exemplary process-flow diagram of FIG. 7 are merely exemplary of a preferred order for the method of manufacturing an insulated retail packaging container. Some steps may be carried out in another order, with or without additional steps included therein. Additionally, the steps may be carried out with any embodiment of bag 10, as contemplated herein.

The method for manufacturing an insulated retail packaging container begins at step 100, during which, an indicia portion (e.g., artwork, logos, designs, etc.) is printed on a transparent material of a panel. In step 110, a layer of protective oil is disposed on top of the printed indicia portion to prevent any damage to the indica portion during the manufacturing process. Next in step 120, a water-soluble agent is applied onto an internal surface of the panel at the intended location(s) of the viewing window(s). In step 130, a thermal insulating layer (e.g., aluminum foil) is applied to the internal surface of the panel. In step 140, the internal surface of the predetermined panel is placed in a washing machine and rinsed with a water-based solution. The interaction of the water-based solution with the water-soluble agent allows a section of the thermal insulating foil to be removed at the intended location of the viewing window, thereby creating a first viewing window. In step 150, the panels containing the viewing windows are dried. Finally, at step 160, the insulated retail packaging container is constructed by joining the various panels to create the insulated bag.

Referring now to FIG. 7, in conjunction with FIGS. 1-6, an exemplary process-flow diagram is provided, depicting a method of packaging a gelatinous consumable product. The steps delineated in the exemplary process-flow diagram of FIG. 7 are merely exemplary of a preferred order for the method of packaging a gelatinous consumable product. Again, some steps may be carried out in another order, with or without additional steps included therein. Additionally, the steps may be carried out with any embodiment of bag 10, as contemplated herein.

The method for packaging a gelatinous consumable product begins at step 200, during which a plurality of individually sealed cups is provided—each cup containing a gelatinous consumable product therein. At step 210, an empty retail packaging bag is provided and includes the components discussed above. In step 220, the empty retail packaging bag is inserted into a production line. Next, the empty retail packaging bag is opened by separating the upper ends of the front and back panels, and a funnel is inserted into the bag at step 230. In step 240, a predetermined number of individually sealed cups are freely disposed in an unorganized manner in the empty retail packaging bag's receiving compartment, resulting in a filled retail packaging bag. Freely disposing the cups within the receiving compartment in an unorganized manner significantly reduces the costs associated with mechanisms or hired hands to organize the cups and the time required to fill the bags. Next, at step 250, the opening is closed by securing the front panel to the back panel of the filled retail packaging bag using a manufacturing seal. The filled retail packaging bag can then be delivered to a retail environment and sold to consumers.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A retail packaging container, comprising:

a plurality of interconnected panels establishing a flexible bag, wherein the plurality of interconnected panels creates an enclosable receiving compartment;

an opening residing at an upper end of the bag, wherein the opening allows the retail packaging container to be filled with a plurality of individually packaged containers and then sealed for distribution;

each individually packaged container including:

a base;

side walls extending from the base to create a cavity;

a consumable product residing within the cavity;

a removable cap configured to retain the consumable product within the cavity;

wherein the plurality of individually packaged containers are freely disposed in an unorganized manner in the receiving compartment, thereby allowing any added ice and/or water to sufficiently surround each of the individually packaged containers.

2. The retail packaging container of claim 1, wherein the flexible bag is waterproof, and the plurality of interconnected panels includes a bottom panel, a front panel, a back panel, and two oppositely located side panels, wherein the front panel, back panel, and two side panels extend upwardly from the bottom panel and each side panel resides at least partially between the front and back panels.

3. The retail packaging container of claim 1, further including a first viewing window disposed on one of the interconnected panels.

4. The retail packaging container of claim 3, further including a second viewing window disposed on one of the interconnected panels.

5. The retail packaging container of claim 4, wherein the first window is disposed on a front panel and the second viewing window is disposed on a back panel.

6. The retail packaging container of claim 1, further including a re-closeable seal configured to temporarily close the bag.

7. The retail packaging container of claim 6, wherein the re-closeable seal has a first engagement section on a front panel proximate an upper end of the front panel and a second engagement member on a back panel proximate an upper end of the back panel and the first and second engagement members are configured to temporarily engage each other.

8. The retail packaging container of claim 7, wherein the seal for distribution resides above the re-closeable seal and permanently seals the filled retail packaging bag until the manufacturing seal is removed from the filled retail packaging bag.

9. The retail packaging container of claim 1, wherein each of the individually packaged containers includes a transparent section comprised of non-consumable material, thereby allowing a user to determine a state of the consumable products within the individually packaged containers.

10. The retail packaging container of claim 1, further including a thermal insulating lining on at least a majority of an internal surface of the receiving compartment.

11. A retail packaging container, comprising:

a plurality of interconnected panels establishing a flexible bag, wherein the plurality of interconnected panels creates an enclosable receiving compartment;

an opening residing at an upper end of the bag, wherein the opening allows the retail packaging container to be filled with a plurality of individually packaged containers;

each individually packaged container including:

a base;

side walls extending from the base to create a cavity;

a consumable product residing within the cavity;

a removable cap configured to retain the consumable product within the cavity;

a first viewing window disposed on one of the plurality of interconnected panels, thereby allowing a user to determine a state of the consumable product in the individually packaged containers housed within the flexible bag;

wherein the plurality of individually packaged containers are freely disposed in an unorganized manner in the receiving compartment, thereby allowing any added ice and/or water to sufficiently surround each of the individually packaged containers.

12. The retail packaging container of claim 11, further including the first viewing window comprised of a transparent material.

13. The retail packaging container of claim 11, further including a thermal insulating lining on at least a majority of an internal surface of the receiving compartment without obstructing the first viewing window.

14. The retail packaging container of claim 11, wherein the individually packaged containers include a transparent section comprised of non-consumable material.

15. The retail packaging container of claim 11, further including a re-closeable seal.

16. The retail packaging container of claim 11, further including a handle.

17. A retail packaging container, comprising:

a plurality of interconnected panels establishing a flexible bag, wherein the plurality of interconnected panels creates an enclosable receiving compartment;

an opening residing at an upper end of the bag, wherein the opening allows the retail packaging container to be filled with a plurality of individually packaged containers;

each individually packaged container including:

a base;

side walls extending from the base to create a cavity;

a consumable product residing within the cavity;

a removable cap configured to retain the gelatinous product within the cavity;

a transparent section comprised of non-consumable material, thereby allowing a user to determine a state of the consumable product within the container;

wherein the plurality of individually packaged containers are freely disposed in an unorganized manner in the receiving compartment, thereby allowing any added ice and/or water to sufficiently surround each of the individually packaged containers.

18. The retail packaging container of claim 17, further including a first viewing window disposed on one of the plurality of interconnected panels.

19. The retail packaging container of claim 17, further including a re-closeable seal configured to temporarily close the bag.

20. The retail packaging container of claim 17, further including a handle.

* * * * *